US007167069B2

(12) United States Patent
Haga

(10) Patent No.: US 7,167,069 B2
(45) Date of Patent: Jan. 23, 2007

(54) COIL BOBBIN AND TRANSFORMER

(75) Inventor: Yuji Haga, Saitama (JP)

(73) Assignee: Tamura Corporation, Tokyo (JP)

( * ) Notice: Subject to any disclaimer, the term of this patent is extended or adjusted under 35 U.S.C. 154(b) by 0 days.

(21) Appl. No.: 11/143,880

(22) Filed: Jun. 1, 2005

(65) Prior Publication Data

US 2005/0275498 A1 Dec. 15, 2005

(30) Foreign Application Priority Data

Jun. 14, 2004 (JP) ..... 2004-175234

(51) Int. Cl.
*H01F 27/30* (2006.01)

(52) U.S. Cl. ..... 336/198

(58) Field of Classification Search ..... 336/65, 336/192, 198, 200
See application file for complete search history.

(56) References Cited

U.S. PATENT DOCUMENTS 6,162,067 A * 12/2000 Haga ..... 439/76.1
6,208,232 B1 * 3/2001 Chen ..... 336/192
6,369,682 B1 * 4/2002 Thompson et al. ..... 336/192
6,661,326 B1 * 12/2003 Yeh et al. ..... 336/208
2002/0017975 A1 * 2/2002 Chiang et al. ..... 336/198

* cited by examiner

*Primary Examiner*—Tuyen T Nguyen
(74) *Attorney, Agent, or Firm*—Lynn & Lynn

(57) ABSTRACT

A coil bobbin for preventing coil lead wires to terminal pins from being loosened, and a transformer employing such coil bobbin. The coil bobbin made of a thermosetting resin is provided with a secondary side terminal base including a first surface to which lead wires of secondary coil wound on the bobbin are led and a second surface provided with terminal pins and perpendicular to the first surface, and with projections projected continuously from both of the first and second surfaces for catching the lead wires to be connected to the terminal pins. The transformer includes primary and secondary coils wound on the bobbin and an iron core mounted about the coils. The lead wires of the secondary coil are led out of the first surface of the secondary side terminal base, caught by the projections and wound on the terminal pins on the second surface of the base.

9 Claims, 5 Drawing Sheets

COIL BOBBIN AND TRANSFORMER

BACKGROUND OF THE INVENTION

1. Field of the Invention

This invention relates to a coil bobbin and to a transformer employing the particular coil bobbin, and, more particularly, to a coil bobbin minimized in size and capable of stably and safely holding lead wires of a coil wound on the bobbin, as well as a small transformer employing this small coil bobbin with a holding arrangement for lead wires of the coil strengthened.

2. Description of Related Art

In manufacturing the transformer, conventionally, as shown in FIG. 5A, a pair of lead wires 111 of a coil on the coil bobbin 100 are hung to a pair of notches 101 provided at an inside corner edge of a terminal base which is on a flange and having terminal pins 102, and then the lead wires 111 are respectively wound on each of the terminal pins 102. Since, in this case, the lead wires 111 are only passed through the notches 101, the wires are apt to move out of the notches to shift on the surface of the bobbin 100, which causes breakage of the wires.

In order to prevent the lead wires from shifting and breaking, a Japanese Laid-Open Patent Publication No. 2002-353040 has suggested a coil bobbin 200 as shown in FIG. 5B, in which a coil bobbin 200 is provided with a terminal base with a pair of grooves 201 extending along in the thickness direction of the flange, i.e., in an axial direction of the bobbin to lie between inner and outer side faces of the terminal base and deep in radial direction of the flange, and with a pair of bosses 221 on the outer side of the terminal base. The load wires 211 are passed respectively through each of the grooves 201, hung around each of the bosses 221 and then led to each of the terminal pins 202 to be wound thereabout. With the use of such long grooves 201 and bosses 221 as above, the lead wires can be stably held, which prevents shifting and breaking of the wires.

The known coil bobbin as described above still has such problem that, as the transformers are minimized in dimensions, the coil bobbin has to be also minimized to have a smaller space for providing the bosses and eventually the bosses have to become smaller. Such minimization of the bosses causes lowering the strength of the bosses and the bosses become more subject to breakage with the lead wires hung on them, and then the lead wires will be subject to shifting and damaging.

The present invention has been suggested to solve the foregoing problem, and an object of the present invention is to provide a coil bobbin capable of stably holding the lead wires in position to positively prevent them from being caused to shift or to be loosened to be damaged, and also to provide a transformer employing such coil bobbin.

SUMMARY OF THE INVENTION

In order to solve the foregoing problem, first, the present invention provides a coil bobbin made of thermosetting resin, comprising at least one terminal base having a first face where at least one lead wire from a coil is to be led out, and a second face which meets the first face and is provided with a plurality of terminal pins, and at least one projection which is provided astride a line between the first face and the second face, projecting out continuously from both of the first and second faces.

According to the present invention, the terminal base has at least one recess which is formed from an edge part of the second face continuously to the first face, and at least a part of the projection is formed in the recess.

Further according to the present invention, the terminal base is provided with at least one guide groove formed in the second face.

To solve the foregoing problem, further, the present invention provides a transformer employing the coil bobbin as described above, and comprising a coil being provided on the bobbin and having lead wires, wherein each of the lead wires led out from the first face is being hung on the projection and wound on one of the terminal pins.

Further, the present invention provides a transformer employing the coil bobbin as described above, and comprising a coil being provided on the bobbin and having lead wires, wherein each of the lead wires from the coil is being placed in the guide groove, led out from the first face, hung on the projection and wound on one of the terminal pins.

Further, the present invention provides a coil bobbin made of a thermosetting resin, comprising a cylindrical drum for mounting thereon primary and secondary coils, a pair of flanges extending radially from both axial ends of the drum to intersect at right angles with the axial direction of the drum, and primary side and secondary side terminal bases respectively made at the same angular position of the flanges and having a first surface on outer side face of the flange where lead wires from the coils are led out and a second surface intersecting substantially at right angles with the first surface and provided with terminal pins for connecting thereto the lead wires, at least said secondary side terminal base further having projections made on a corner edge between the first and second surfaces at positions respectively close to each terminal pin so as to project continuously out of both of the first and second surfaces for catching thereon the lead wires led out of the first surface and onto the second surface to be connected to the terminal pins.

According to the present invention, the coil bobbin is provided with a recess made to start from an end corner of the second surface to a terminating corner of the first surface, and the projections are provided in the recess.

Further according to the present invention, the coil bobbin as described in the above has a guide groove made in the second surface of the terminal base, to lie between the projections from inner side surface to the outer side first surface.

To solve the foregoing problem, further, the present invention provides a transformer employing the coil bobbin as described above, wherein the coil bobbin includes primary and secondary coils wound on the cylindrical drum and respectively having lead wires led through the terminal base out of the first surface and onto the second surface to be wound on the terminal pins as caught by each of the projections.

In the foregoing transformer of the present invention, the coil bobbin has a guide groove in the second surface of the terminal base, the lead wires on the inner side surface of the base being led through the guide groove out of the first surface and onto the second surface to be wound on the terminal pins as caught by the projections.

DETAILED DESCRIPTION OF THE PREFERRED EMBODIMENTS

The preferred embodiments according to the present invention shall now be described in the followings with reference to the drawings.

Embodiment 1

Figure 1:
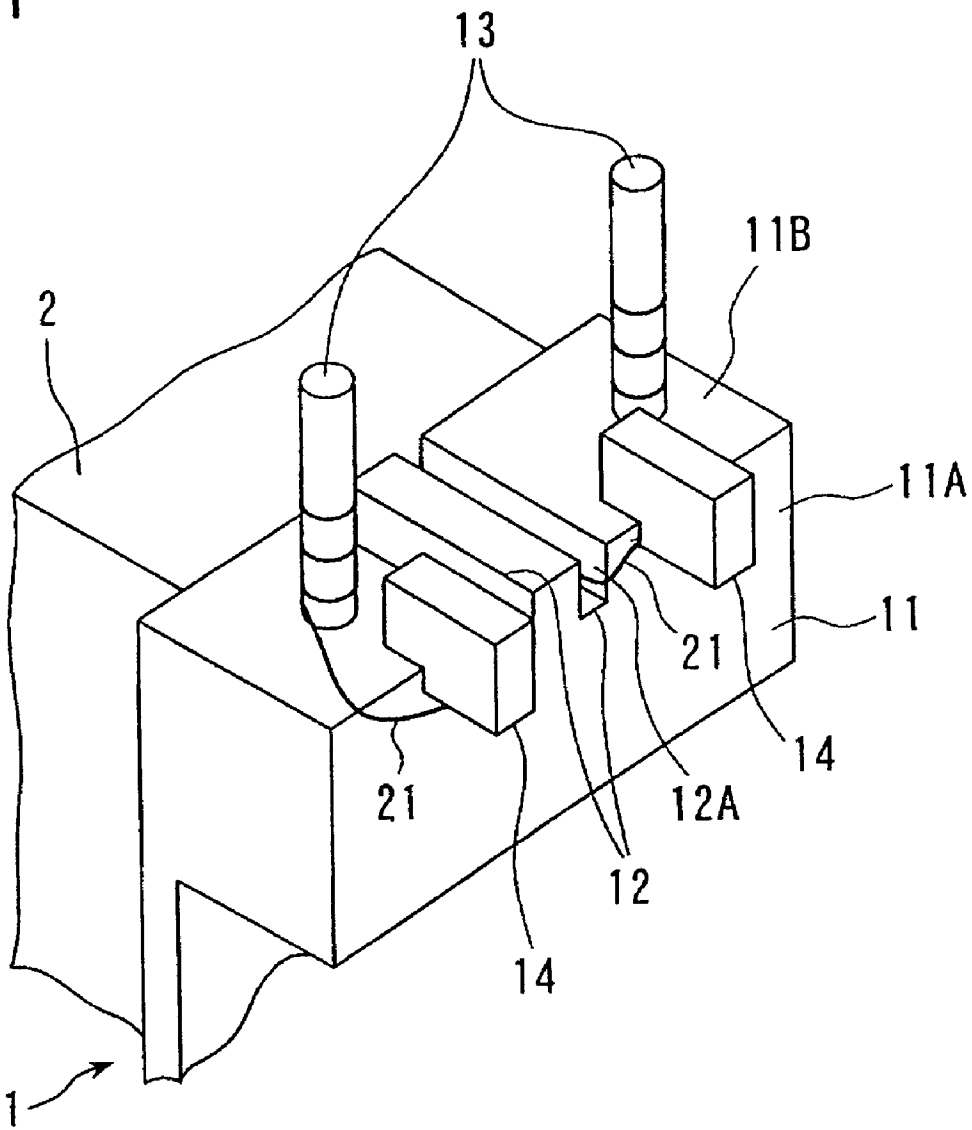
FIG. 1 is a fragmentary perspective view at a terminal base of a coil bobbin in a first embodiment according to the present invention.

In FIG. 1, a coil bobbin 1 in an embodiment according to the present invention is shown fragmentary with part of one of terminal bases 11, which bases are formed on the same angular position of flanges respectively extending radially out of each axial end of a cylindrical drum on which a coil 2 is wound. The terminal base 11 includes first and second surface 11A and 11B which meet substantially at right angles. The first surface 11A faces axial outer side with respect to the coil 2 on the drum and the second surface 11B faces radial outer side of the flange. The terminal base 11 further includes a pair of guide grooves 12 substantially across the center part of the second surface 11B for guiding later described lead wires 21 of the coil 2, so that both end guide ports 12A of the guide grooves 12 will open at the first outer side surface 11A and at the opposite inner side surface facing the coil 2. A pair of terminal pins 13 made of a conductive metal is erected on the second surface 11B for connecting thereto the lead wires 21 and for mounting the coil bobbin 1 to a substrate not shown.

The terminal base 11 is provided with a pair of rectangular parallelepiped projections 14, which are for catching the lead wires 21, being made to project at a corner edge between the first and second surfaces 11A and 11B and continuously out of both of the surfaces, i.e. so as to ride on both surfaces at the corner edge. This makes the projections 14 have more parts in common with the terminal base 11, and as a result, the projections 14 are increased in the strength, which makes it possible to make the bobbin smaller without making it subject to breakage. The coil bobbin 1 including the projections 14 is formed with a thermosetting resin, as molded under heat to set into the coil bobbin formation.

On preparing a transformer with the coil 2 wound on the coil bobbin 1, the lead wires 21 of the coil 2 are passed through the guide grooves 12, led out of the guide ports 12A of the grooves, being caught by the projections 14, and wound on the terminal pins 13. As a result, the projections 14 hold the lead wires 21, and the lead wires 21 can be guided to the terminal pins 13 without being loosened.

Figure 2:
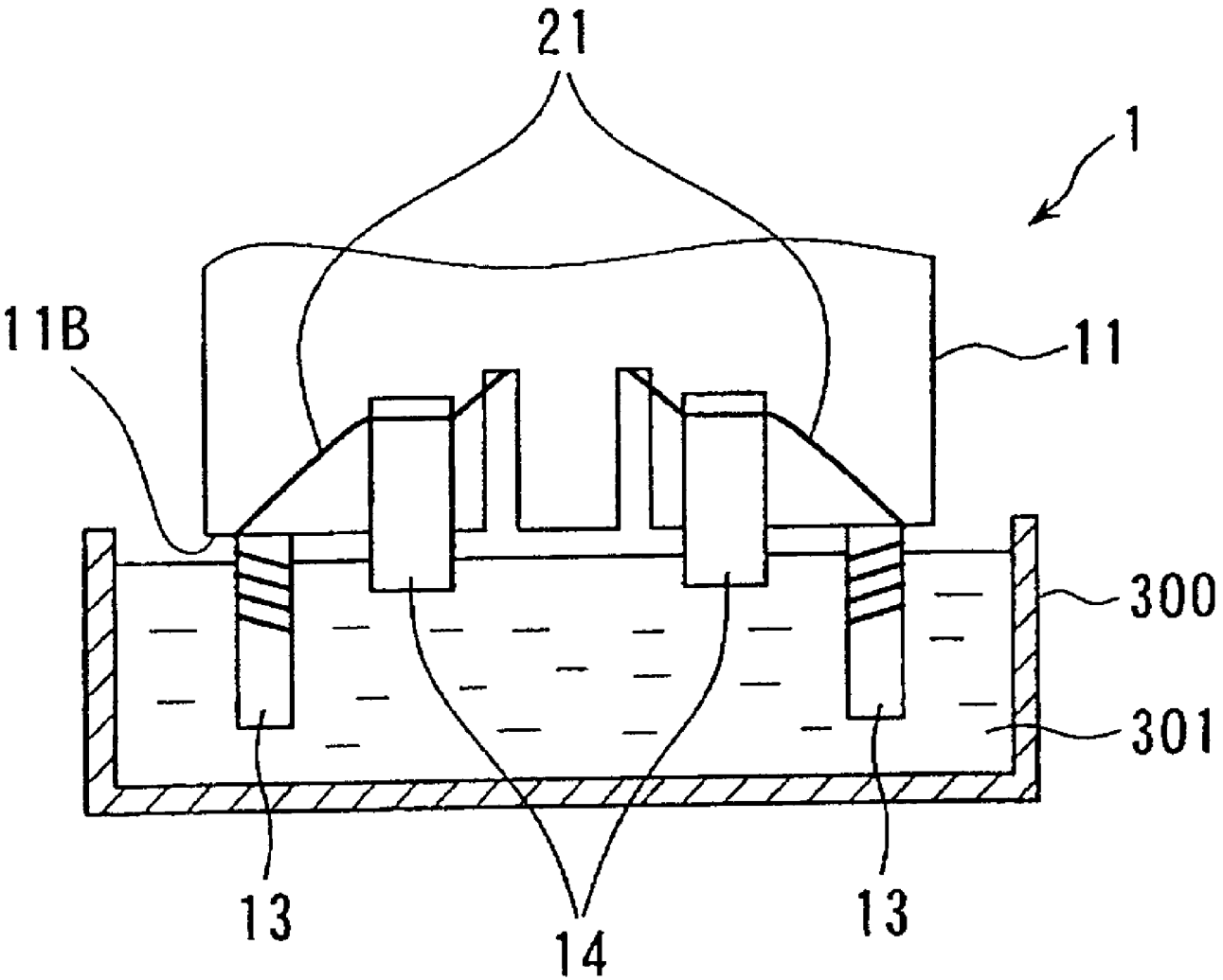
FIG. 2 is an explanatory view for a manner of soldering lead wires with respect to terminal pins in the coil bobbin of FIG. 1.

As the coil 2 are thus mounted, the terminal pins 13 on the terminal base 11 are dipped into a molten solder 301 in a solder bath 300 as shown in FIG. 2, with the second surface 11B of the terminal base 11 facing to the molten solder 301, whereby the lead wires 21 are soldered to the terminal pins 13 at parts of the wires 21 wound on the pins. Since the coil bobbin 1 including the projections 14 is formed of the thermosetting resin, in this case, the high heat resistance of the resin prevents the projections 14 from being deformed even when the projections 14 are dipped in the molten solder 301 at a high temperature, and the lead wires 21 are prevented from being loosened and become movable.

Embodiment 2

A practical example of the coil bobbin according to the present invention shall be explained with reference to FIGS. 3A to 3E A coil bobbin 3 in this embodiment is shown to generally comprise a primary side terminal base 31, a coil winding drum 32 and a secondary side terminal base 33. The primary side terminal base 31 includes a base part 31A having on its bottom face a plurality of conductive metal-made terminal pins 31C and on its outer side face a plurality of boss-type projections 31D respectively corresponding to each terminal pin 31C. The coil winding drum 32 is provided between a flange 31B of the primary side terminal base 31 and a flange 33B of the secondary side terminal base 33, for forming thereon primary and secondary coils wound on the drum 32 and between both flanges 31B and 33B.

Figure 3A:
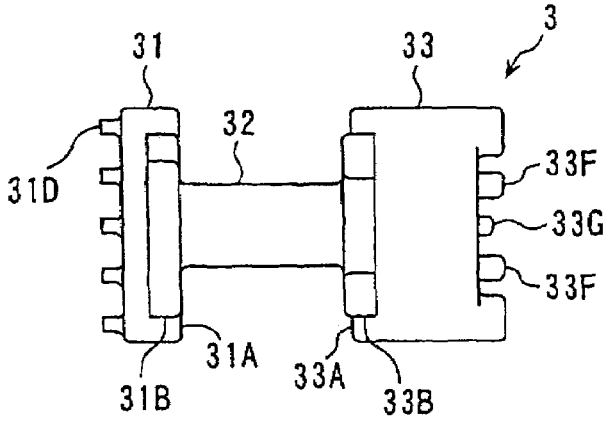
FIG. 3A is a top plan view of the coil bobbin in a second embodiment according to the present invention.
Figure 3B:
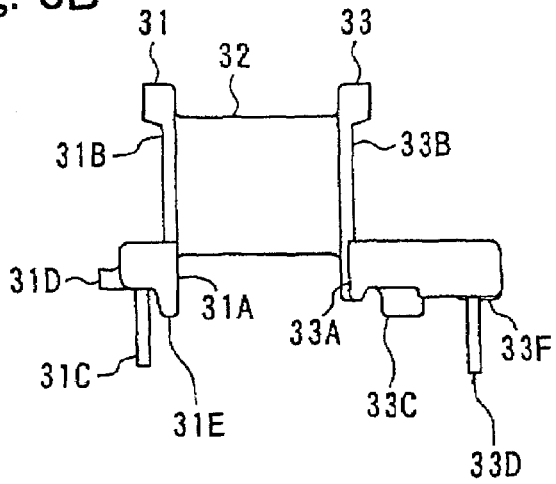
FIG. 3B is a front side view of the coil bobbin of FIG. 3A.
Figure 3D:
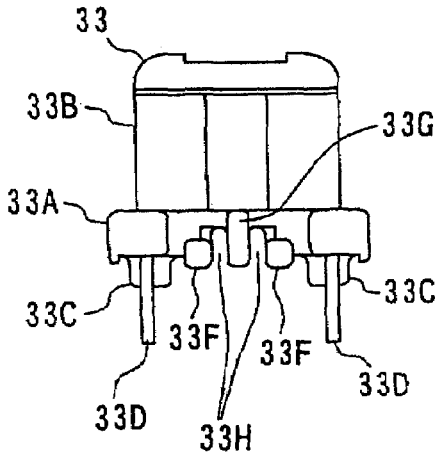
FIG. 3D is a side view of the coil bobbin of FIG. 3A.
Figure 3C:
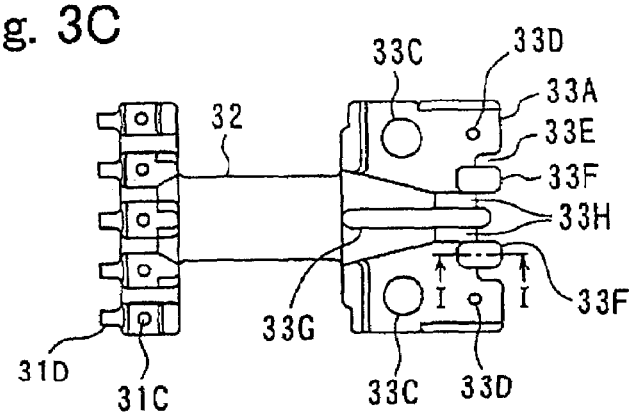
FIG. 3C is a bottom plan view of the coil bobbin of FIG. 3A.
Figure 3E:
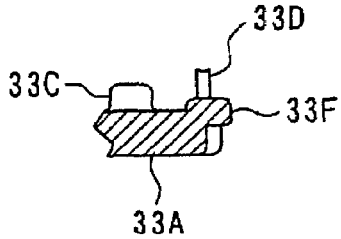
FIG. 3E is a fragmentary sectioned view taken along line I—I in FIG. 3C of the coil bobbin of FIG. 3A.

The secondary side terminal base 33 is formed into an L-shape, as seen in FIG. 3B, with a base part 33A and the flange 33B. The base part 33A formed rectangular as seen in bottom view of FIG. 3C has on its bottom face a pair of stand-off parts 33C, for assuring a clearance between a substrate and a transformer employing the coil bobbin and mounted onto the substrate. On the side of the primary side terminal base 31, projected parts 31E on the bottom face attain the same function as the stand-off parts 33C. At both corner portions on the bottom face of the base part 33A, a pair of conductive metal-made terminal pins 33D is erected. A recess 33E is formed at a part positioned between the terminal pins 33D, in an outer extended end corner of the bottom face, that is, to open on an outer side face of the basepart 33A with respect to the drum 32. In other words, the recess 33E is made from the outer edge part of the bottom face continuously to the outer face of the base part 33A.

The base part 33A of the secondary side terminal base 33 is provided with a pair of retangular parallelepiped projections 33F for catching the lead wires, as formed to ride on both of the bottom face of the base part 33A and the bottom of the recess 33E in the outer side face of the base part 33A. The projections 33F are formed so as not to extend out of the recess 33E. Since the projections 33F are thus projecting continuously out of two faces of the base part 33A where the lead wires of the coil are passed, the projections for catching the wires are enlarged and consequently increased in the strength. At the same time, the coil bobbin 3 can be prevented from being enlarged in size, since the projections 33F are provided at least partially in the recess 33E so as no to project out from the outer side surface of the bobbin 3.

In the center of the bottom face of the base part 33A, a partition 33G is provided, and each of a pair of guide grooves 33H is made in the bottom face between each lateral side of the partition 33G and each projection 33F, while the projection 33F forms part of side wall of each groove 33H.

The coil bobbin 3 having the foregoing structure is also made of a thermosetting resin, i.e., a thermosetting resin is put in a mold and hardened by heat to form the coil bobbin 3 by molding. In the present embodiment, phenolic resins, diallyl series resins and the like are used as the thermosetting resin.

Embodiment 3

Figure 4A:
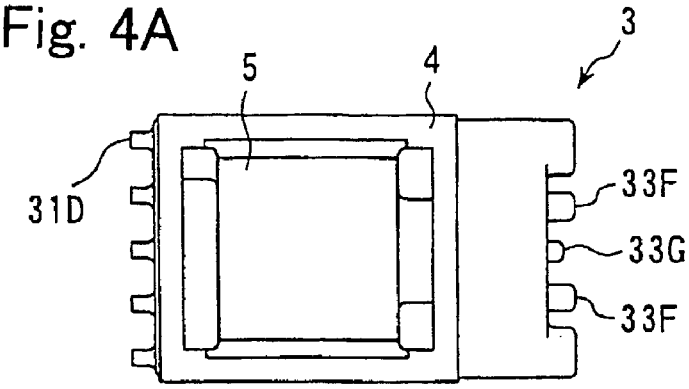
FIG. 4A is a top plan view of a transformer employing the coil bobbin shown in FIG. 3.
Figure 4B:
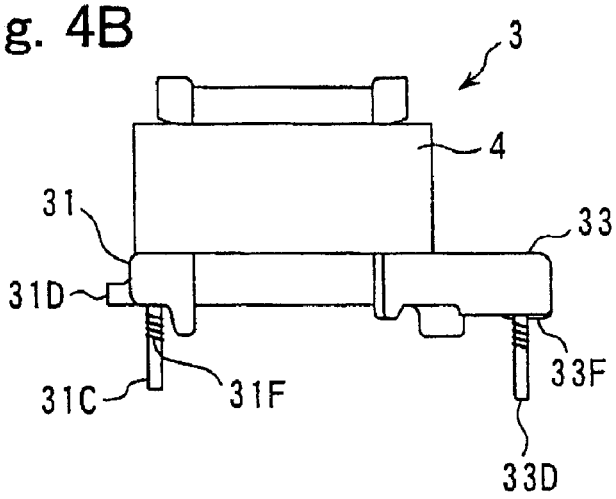
FIG. 4B is a front side view of the transformer shown in FIG. 4A.
Figure 4D:
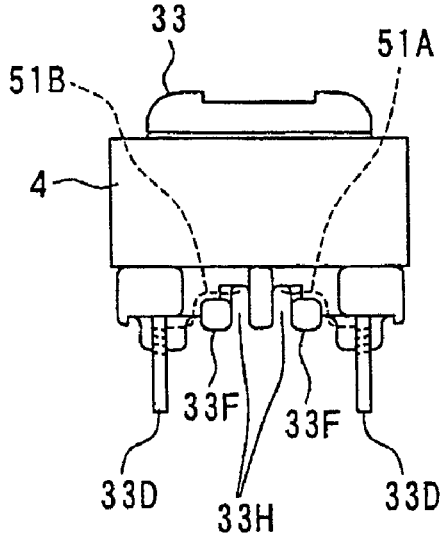
FIG. 4D is a side view of the transformer of FIG. 4A.
Figure 4C:
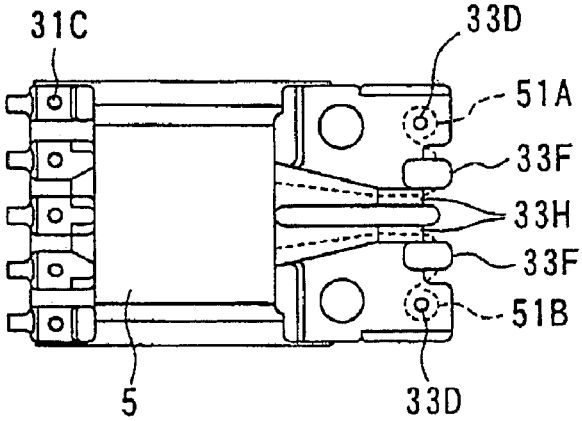
FIG. 4C is a bottom plan view of the transformer of FIG. 4A.
Figure 5A:
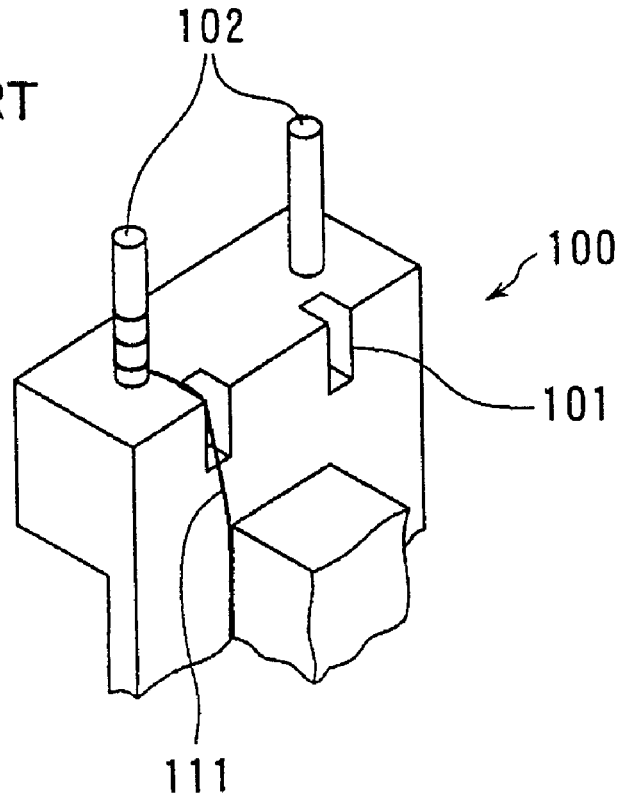
Fig. 5A PRIOR ART
FIG. 5A is a fragmentary perspective view at a terminal base of a conventional coil bobbin having no projection, for explaining a connection of the lead wires to the terminal pins.
Figure 5B:
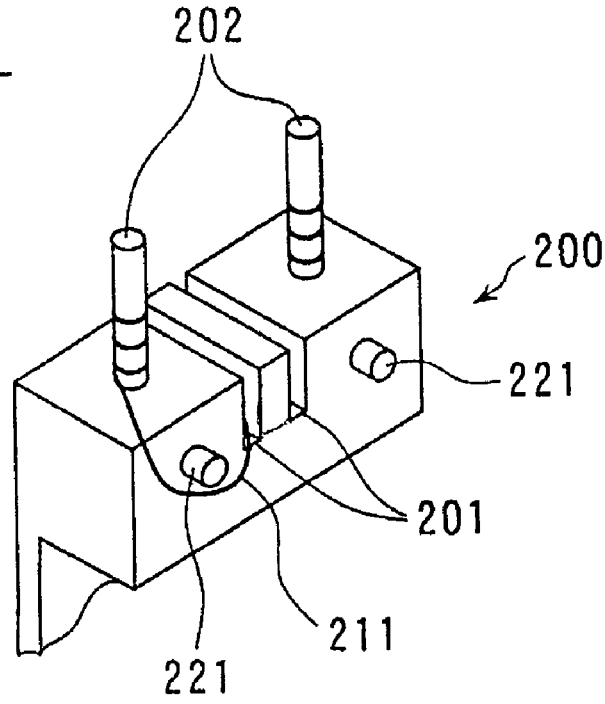
Fig. 5B PRIOR ART
FIG. 5B is a fragmentary perspective view similar to FIG. 5A but in the case of a conventional coil bobbin having projections.

Next, a transformer employing the coil bobbin 3 described above shall be explained as a third embodiment of the present invention, with reference to FIGS. 4A–4D. In the drawings, a coil block 5 is formed on the coil winding drum 32 and between the flanges 31B and 33B, and a core 4 is mounted around the coil block 5 and flanges 31B and 33B with center leg of the core 4 inserted in the drum 32 from both axial ends thereof. Thereafter, the lead wires 51A and 51B forming starting and terminating ends of the winding are led to the secondary side terminal base 33 to be wound on the terminal pins 33D. In this case, the lead wires 51A and 51B appearing on the inner side of the flange 33B are led through the guide grooves 33H and out of the guide ports on the outer side recess 33E, as seen in FIG. 4D, and are then caught by the projections 33F and wound on the terminal pins 33D, as seen in FIG. 4C. Consequently, the lead wires 51A and 51B caught by the projections 33F as led out of the ports of the guide grooves 33H can be prevented from being caused to escape from the caught position on the projections 33F. The winding direction of the lead wires 51A and 51B with respect to the terminal pins 33D may be opposite to the one shown in FIG. 4C.

Referring to the primary side terminal base 31 having a plurality of the terminal pins 31C erected on the bottom surface and a plurality of boss-type projections 31D, the lead wires 31F led out on the bottom surface are first caught respectively by each of the projections 31D and then wound on each of the terminal pins 31C.

Thereafter, the transformer incorporating the coil bobbin 3 with the core 4 and coil block 5 carried thereon is brought over the solder bath to dip the terminal pins 31C and 33D into the molten solder, so as to connect the primary side lead wires 31F to the pins 31C and the secondary side lead wires 51A and 51B to the pins 33D. Since, in this case, the coil bobbin 3 is formed with the thermosetting resin, the high heat resistance of the resin is effective to prevent the projections 33F from being deformed and the lead wires 51A and 51B from being loosened, even when the projections 33F are dipped into the molten solder at the high temperature. Further, in this soldering, the lead wires 51A and 51B are led through the guide grooves 33H, so that the wires are kept away from the molten solder, the solder being not caused to enter into the grooves and thus being prevented from sticking to the lead wires kept within the grooves.

While the present invention has been described with reference to the practical embodiments, the present invention in its practical arrangement should not be limited only to those described, but all equivalent arrangements and design modification made without departing from the spirt and scope of the appended claims should be included in the invention. For example, the projections 14 and 33F have been described as being formed to have rectangular parallelepiped shapes, but may be of any shape in any formation so long as the lead wires can stably be caught.

What is claimed is:

1. A coil bobbin made of a thermosetting resin, comprising a cylindrical drum for mounting thereon primary and secondary coils, a pair of flanges extending radially from both axial ends of the drum to intersect at right angles with the axial direction of the drum, and primary side and secondary side terminal bases respectively made at the same angular position of the flanges and having a first surface on outer side face of the flange where lead wires from the coils are led out and a second surface intersecting substantially at right angles with the first surface and provided with terminal pins for connecting thereto the lead wires, at least the secondary side terminal base further having projections made on a corner edge between the first and second surfaces at positions respectively close to each terminal pin so as to project continuously out of both of the first and second surfaces for catching thereon the lead wires led out of the first surface and onto the second surface to be connected to the terminal pins.

2. The coil bobbin according to claim 1, wherein the secondary side terminal base is provided with a recess made from an end corner of the second surface to a terminating corner of the first surface, and the projections are provided in the recess.

3. The coil bobbin according to claim 1 or 2, wherein the secondary side terminal base has a guide groove made in the second surface, to lie between the projections from inner side surface of the base to the outer side first surface.

4. A transformer employing the coil bobbin according to claim 1, wherein the coil bobbin includes primary and secondary coils wound on the cylindrical drum and respectively having lead wires led through the terminal base out of the first surface and onto the second surface to be wound on the terminal pins as caught by each of the projections.

5. The transformer according to claim 4, wherein the coil bobbin has a guide groove in the second surface of the secondary side terminal base, the lead wires on the inner side surface of the base being led through the guide groove out of the first surface and onto the second surface to be wound on the terminal pins as caught by the projections.

6. A transformer employing the coil bobbin according to claim 2 wherein the coil bobbin includes primary and secondary coils wound on the cylindrical drum and respectively having lead wires led through the terminal base out of the first surface and onto the second surface to be wound on the terminal pins as caught by each of the projections.

7. A transformer employing the coil bobbin according to claim 3 wherein the coil bobbin includes primary and secondary coils wound on the cylindrical drum and respectively having lead wires led through the terminal base out of the first surface and onto the second surface to be wound on the terminal pins as caught by each of the projections.

8. The transformer according to claim 6, wherein the coil bobbin has a guide groove in the second surface of the secondary side terminal base, the lead wires on the inner side surface of the base being led through the guide groove out of the first surface and onto the second surface to be wound on the terminal pins as caught by the projections.

9. The transformer according to claim 7, wherein the coil bobbin has a guide groove in the second surface of the secondary side terminal base, the lead wires on the inner side surface of the base being led through the guide groove out of the first surface and onto the second surface to be wound on the terminal pins as caught by the projections.

* * * * *